US011035367B1

(12) United States Patent
Hansen et al.

(10) Patent No.: US 11,035,367 B1
(45) Date of Patent: Jun. 15, 2021

(54) SUMP PUMP SYSTEM WITH AN ELECTRONIC CONTROLLER MODULE SECURED IN A SUMP PUMP POWER CORD

(71) Applicant: FLINT & WALLING, INC., Kendallville, IN (US)

(72) Inventors: Eric J. Hansen, Fort Wayne, IN (US); Josh Tang, Westford, MA (US); Daniel R. Tang, Chelmsford, MA (US); Joseph Duff, Louisville, KY (US); Jeff Sloss, Fisherville, KY (US)

(73) Assignee: Flint & Walling, Inc., Kendallville, IN (US)

( * ) Notice: Subject to any disclaimer, the term of this patent is extended or adjusted under 35 U.S.C. 154(b) by 0 days.

(21) Appl. No.: 16/288,687

(22) Filed: Feb. 28, 2019

Related U.S. Application Data

(60) Provisional application No. 62/637,108, filed on Mar. 1, 2018.

(51) Int. Cl.

| | |
|---|---|
| ***F04D 13/06*** | (2006.01) |
| ***F04B 23/02*** | (2006.01) |
| ***F04D 13/08*** | (2006.01) |
| ***F04B 49/06*** | (2006.01) |
| ***F04B 17/03*** | (2006.01) |
| ***F04B 49/025*** | (2006.01) |
| ***F04D 13/16*** | (2006.01) |
| ***F04B 49/04*** | (2006.01) |
| ***F04D 15/02*** | (2006.01) |

(52) U.S. Cl.
CPC ..... *F04D 13/0693* (2013.01); *F04B 17/03* (2013.01); *F04B 23/021* (2013.01); *F04B 49/025* (2013.01); *F04B 49/04* (2013.01); *F04B 49/06* (2013.01); *F04D 13/06* (2013.01); *F04D 13/08* (2013.01); *F04D 13/086* (2013.01); *F04D 13/16* (2013.01); *F04D 15/0218* (2013.01); *F04D 15/02* (2013.01)

(58) Field of Classification Search
CPC .... F04D 13/08; F04D 13/086; F04D 13/0693; F04D 13/0686; F04D 15/0077; F04D 15/0094; F04D 13/06; F04D 13/16; F04D 15/2018; F04D 15/02; F04B 23/02; F04B 23/021; F04B 17/03; F04B 49/025; F04B 49/04; F04B 49/06
See application file for complete search history.

(56) References Cited

U.S. PATENT DOCUMENTS

| | | | | |
|---|---|---|---|---|
| 4,080,104 | A * | 3/1978 | Brown, Jr. ..... | A47L 7/0028 15/353 |
| 5,100,343 | A * | 3/1992 | Peterson ..... | H01R 13/523 417/40 |
| 6,375,430 | B1 | 4/2002 | Eckhart et al. | |
| 6,464,531 | B2 | 10/2002 | Eckert et al. | |
| 7,429,842 | B2 | 9/2008 | Schulman et al. | |
| 8,380,355 | B2 | 2/2013 | Mayleben et al. | |

(Continued)

*Primary Examiner* — Bryan M Lettman
(74) *Attorney, Agent, or Firm* — Scott R. Cox

(57) ABSTRACT

A sump pump system with a sump pump, a sump pump electrical cord connected to the sump pump, and a housing that is secured in line with, and an integral component of, the sump pump electrical cord. An electronic controller is located within the housing and comprises sensors, processors, a switch, and audible and visual alarms and indicators, wherein the switch and visual alarms and indicators are located on a face of the housing.

16 Claims, 5 Drawing Sheets

(56) References Cited

U.S. PATENT DOCUMENTS

| | | | | |
|---|---|---|---|---|
| 9,362,072 | B2 | 6/2016 | Davis et al. | |
| 9,441,625 | B2 | 9/2016 | Schoendorff | |
| 9,528,523 | B2 | 12/2016 | Cummings | |
| 9,696,360 | B2 | 7/2017 | Rothbart | |
| 9,927,479 | B2 | 3/2018 | Rothbart | |
| 2008/0031752 | A1* | 2/2008 | Littwin | F04D 15/0218 417/411 |
| 2010/0166570 | A1* | 7/2010 | Hampton | F04D 9/001 417/36 |
| 2011/0311370 | A1* | 12/2011 | Sloss | F04B 49/02 417/1 |
| 2013/0294931 | A1* | 11/2013 | Magnusson | F04D 15/0218 417/44.1 |
| 2014/0271126 | A1* | 9/2014 | Gray | F04B 15/02 415/88 |
| 2015/0143891 | A1* | 5/2015 | Cummings | F04D 15/0088 73/168 |
| 2015/0240803 | A1* | 8/2015 | Knight | F04B 51/00 73/168 |
| 2015/0343143 | A1* | 12/2015 | Estes | G16H 20/17 604/500 |

* cited by examiner

SUMP PUMP SYSTEM WITH AN ELECTRONIC CONTROLLER MODULE SECURED IN A SUMP PUMP POWER CORD

CROSS-REFERENCE TO RELATED APPLICATION

This Application claims benefit of Provisional Application No. 62/637,108, filed on Mar. 1, 2018. The entire contents of the above-application is incorporated herein by reference.

FIELD OF THE INVENTION

The present invention relates to the technical field of electronics used with a sump pump. More particularly, the present invention relates the technical field of electronic control, testing and monitoring of connected components of a sump pump system.

BACKGROUND

A sump pump is often the first line of defense against rain water, water heater failure, or a plumbing failure. A sump pump may fail for many reasons, which can cause flooding and damage. Many factors can cause a sump pump to operate incorrectly, and a known solution to detect these sump pump failures includes the use of an electronic controller module ("ECM"). In the past, ECMs that have been used to detect sump pump failure are independent of the sump pump system, as shown in U.S. Pat. No. 9,696,360. However, there are numerous drawbacks associated with the ECM because they are independent of the sump pump system, such as electrical connection issues between the pump, switches, and controls. In addition, prior art ECMs are not water resistant, and, if accidentally dropped into the sump pump pit or basement, may be permanently damaged.

The inventors have discovered a solution to the problems associated with the use of ECMs that are independent of the sump pump by incorporating an ECM into a sump pump electrical cord. The inventors have solved the electrical connection issues raised in the past by inventing a sump pump system that is a single, continuous, assembly. Accordingly, there are no electrical connections to make between pump, switches, and the controls except for plugging the system into household power. Further, this system is universally operable with a variety of pumps, battery systems, and other pump components.

SUMMARY OF INVENTION

One embodiment of the invention includes a sump pump system with a sump pump, a sump pump electrical cord connected to the sump pump, and a housing that is secured in line with, and an integral component of, the sump pump electrical cord. In this embodiment, an electronic controller module is located within the housing and comprises various components, such as sensors or processors, a switch, and audible and visual alarms and indicators, wherein the switch and audible and visual alarms and indicators are located on a face of the housing.

BRIEF DESCRIPTION OF DRAWINGS

FIG. 5 is a top perspective view of a sump pump basin cover with a hole that the sump pump electrical cord with the housing of the ECM passes through.

DETAILED DESCRIPTION OF DRAWINGS

Figure 1:
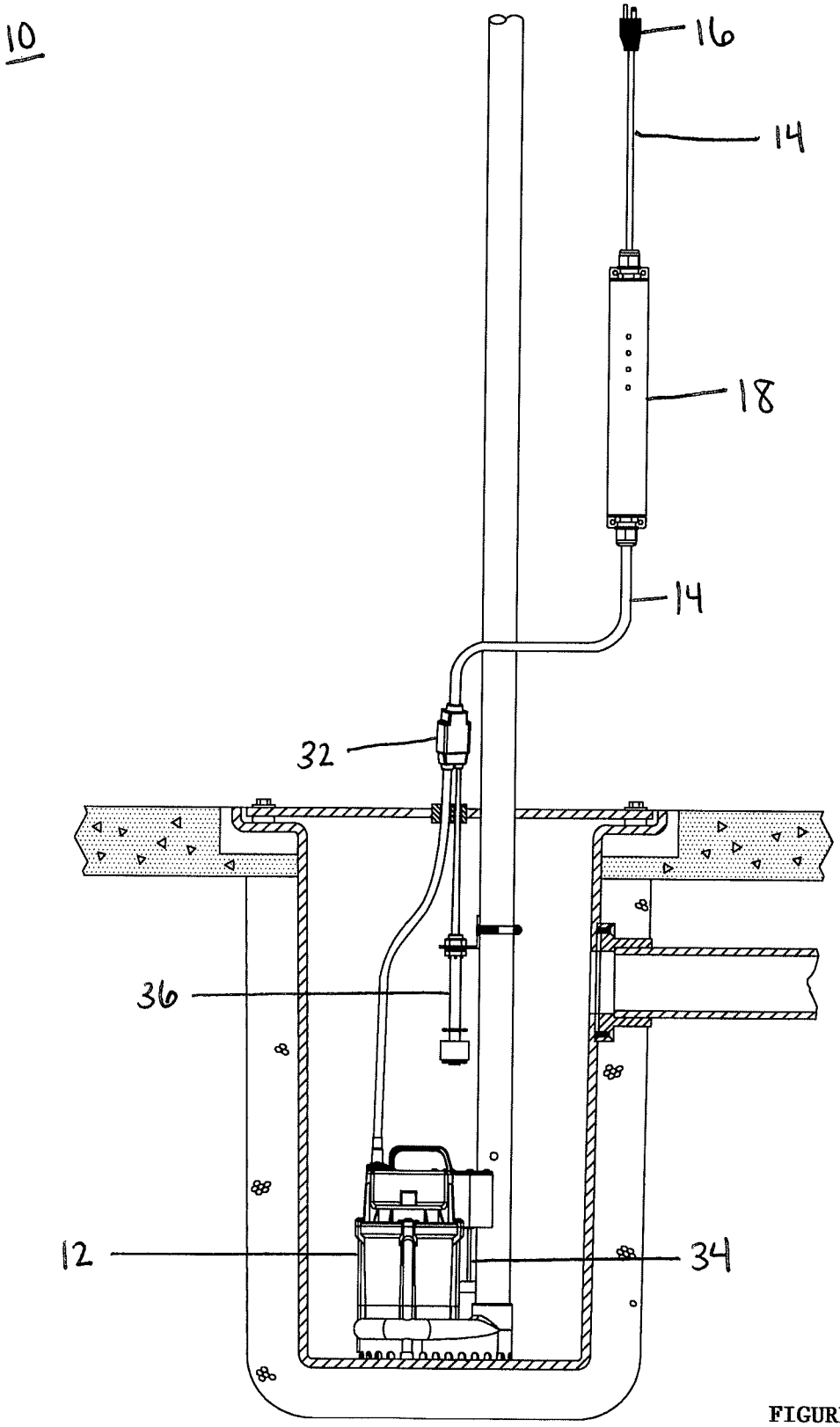
FIG. 1 is a front view of a sump pump system with an ECM secured in a sump pump electrical cord.

FIG. 1 illustrates a front view of one embodiment of a sump pump system (10) that includes an ECM (20) secured in the electrical cord (14) of the sump pump (12). The sump pump system includes a sump pump, such as a Zoller® M63 or compatible sump pump. Preferably, the pumps that this can be used with are not using mechanical relays/switches to turn themselves on. Instead, they use solid state switches, or triacs to accomplish this function. Advantageously, these parts typically take a low voltage and/or current to turn on, a control lead can be wired to the triac in parallel with a float switch or a backup float switch and turn the triac on remotely from a controller. As they are in parallel, electrical components cannot be turned off if the float switch or backup float switch is turning the pump on. For example, in one embodiment, the pump is automated and a float switch (34) is an integral part of the pump and the ECM does not receive feedback from this float switch. Further, a backup float switch (36) is connected to the ECM and there is a connection from the ECM to the pump enabling the ECM to start and stop a pump that is not running, but that has no control over a running pump.

The sump pump includes a sump pump electrical cord (14) connected to the sump pump. One end of the electrical cord includes a plug (16) that is connected to a power source to supply power to the sump pump system, while an opposite end of the electrical cord is connected to the sump pump. In this embodiment, the opposite end of the electrical cord connects to a top portion of the sump pump.

Figure 2:
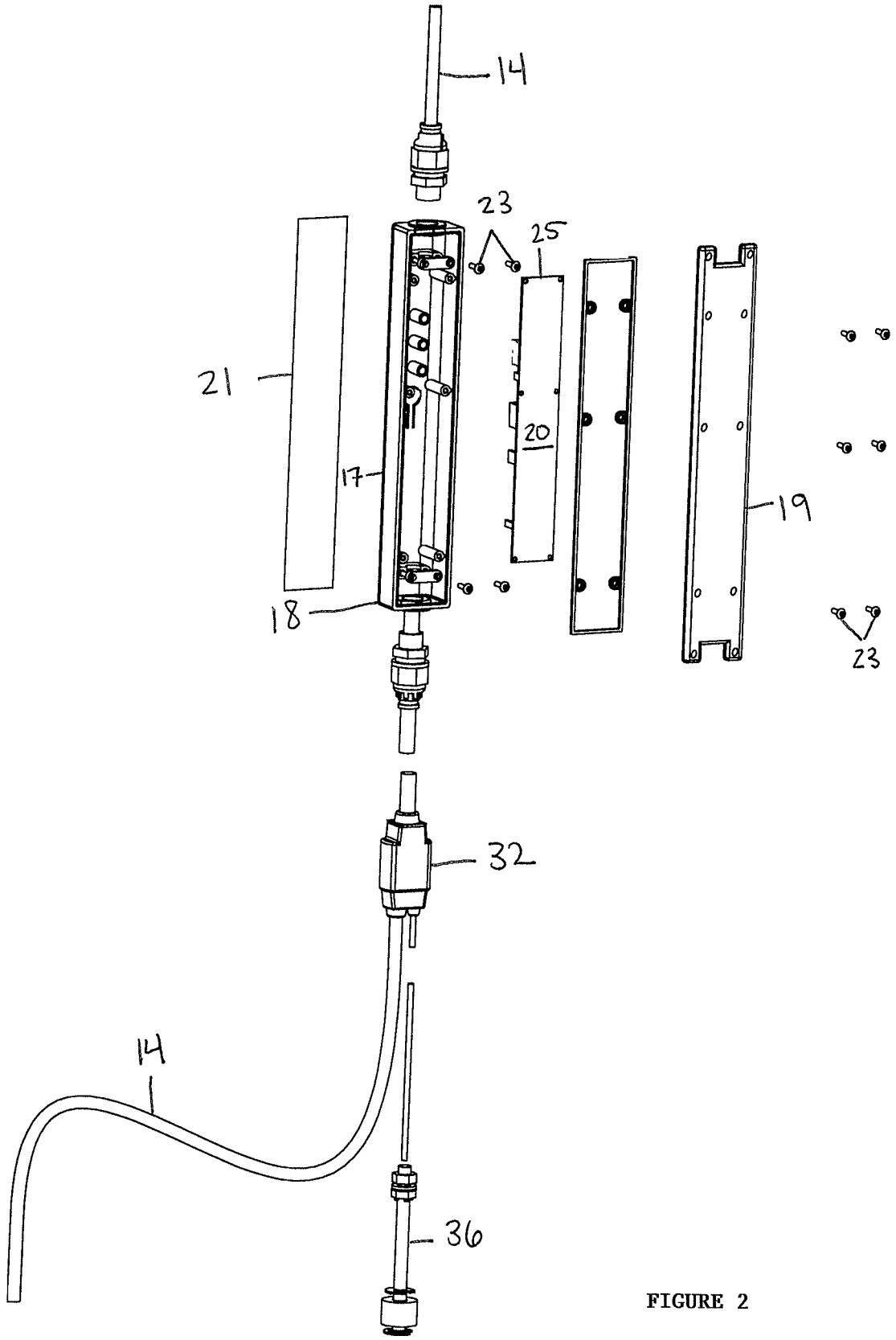
FIG. 2 is a perspective, exploded view of the ECM secured in the sump pump electrical cord of the sump pump system of FIG. 1.

As shown in FIG. 1, the sump pump electrical cord (14), includes a housing (18) that is secured in line with, and is an integral component of, the electrical cord. In this embodiment, the electrical cord includes a three-conductor jacketed cable that extends about one foot from a base of the plug (16) to a top of the housing. The housing can be made of any material, but a water-resistant material is preferable, such as a thermoplastic material. It is known that a common problem that can occur with sump pump systems is the accidental submersion components thereof in water due to accidental dropping during installation. One advantageous result of the housing of this system is that the inner contents of the housing are kept dry by a water-resistant design and waterproof over molded junction of the housing, which may be aided by use of a gasket that seals the two sections of the housing. This allows an accidental, short term submersion in water by the user without adversely affecting the inner contents of the housing. Further, it helps prevent safety issues that can occur upon the submersion of electronic components in water. As shown in FIG. 2, the housing includes two sections (17, 19) that are fastened together around the inner contents (25) of the housing, for instance with recessed screws (23), to form a water-resistant seal.

Figure 4:
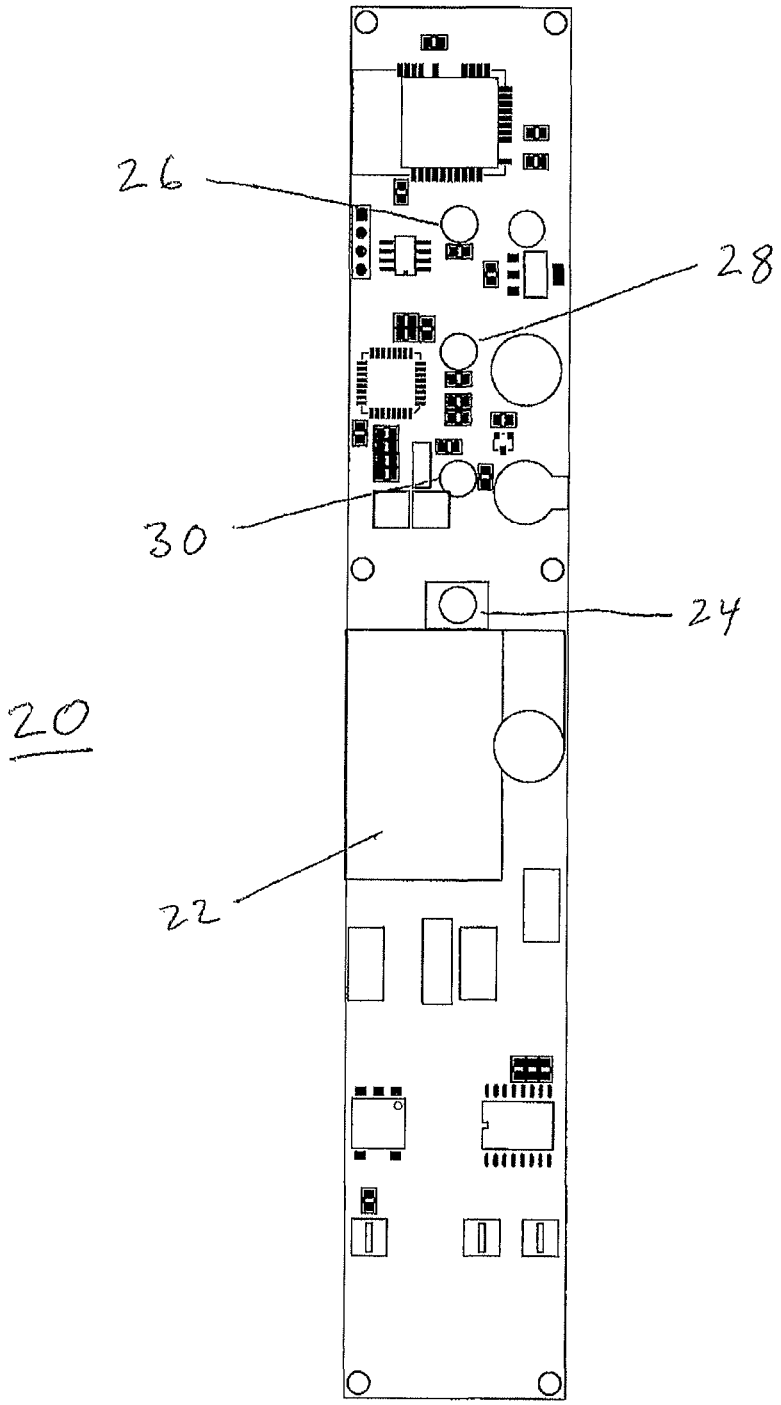
FIG. 4 is front open-faced view of the electronic controller module of the sump pump system of FIG. 1.

As shown in FIG. 2, in this embodiment, the inner contents (25) of the housing (18) include an ECM (20). The ECM mechanically supports, and electrically connects to, a variety of components of the sump pump system (10). In one embodiment, the ECM has a plurality of sensors (22), as seen in FIG. 4, that sense and notify the user of a multitude of potential errors or malfunctions occurring in the sump pump system. Further, there are also processors that process this information and notify the user of these errors. In this embodiment, the ECM also connects to three LEDs (26, 28, 30) and a switch (24), each of which are visible on a face (21) of the housing as the audible and visual alarms and indicators and notify a user of several functions and/or malfunctions of the sump pump system. The LEDs can be any color, but preferably each LED is a different color, so when the user looks at the face of the ECM, the user is aware of the potential problem just by recognizing the color of the LED. Further, these LEDs may flash or blink, and may flash or blink at varying rates to alert the user of different malfunctions of the sump pump system.

Figure 3:
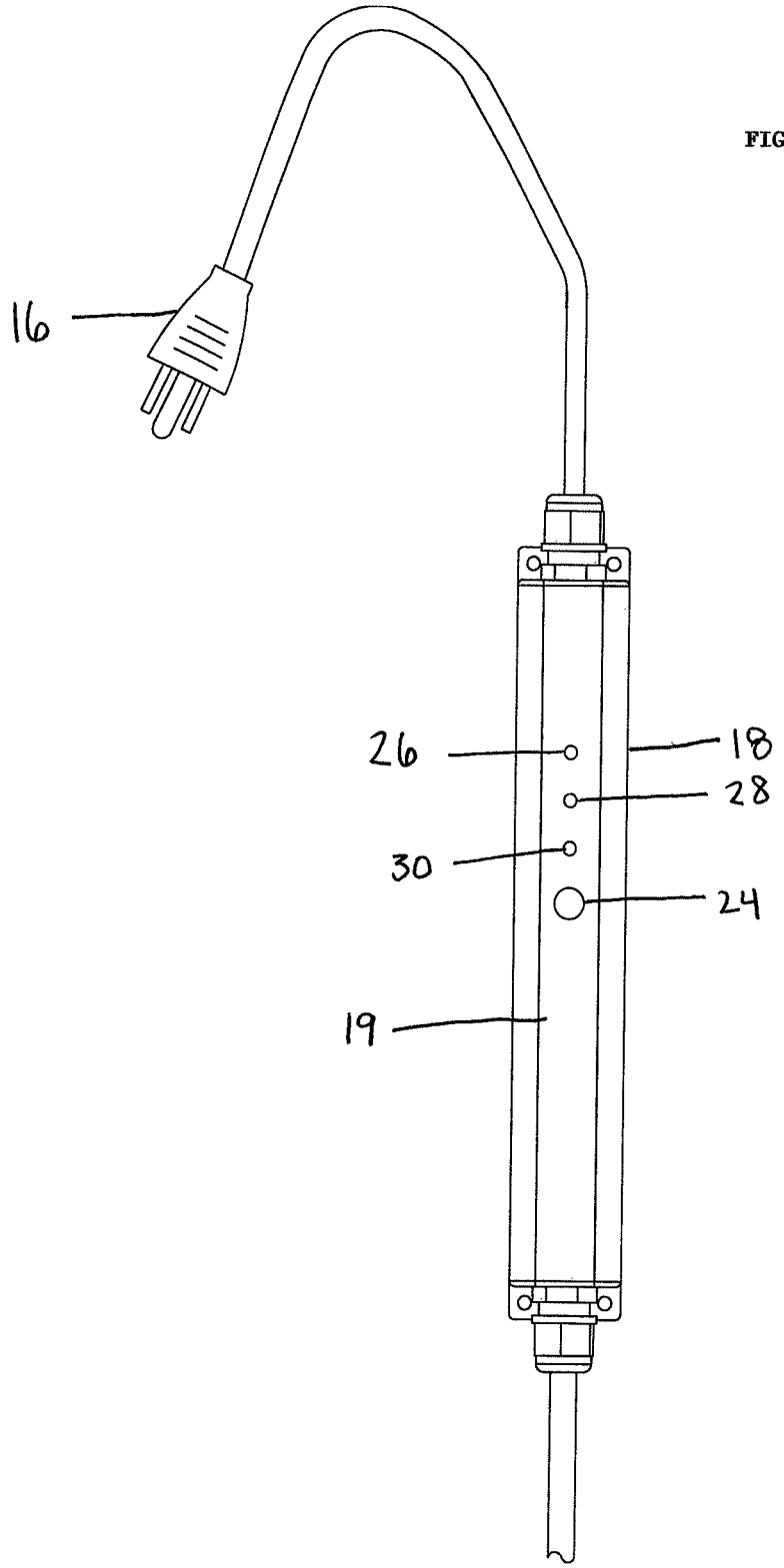
FIG. 3 is a front view of a front face of a housing of the ECM of the sump pump system of FIG. 1.

As shown in FIG. 3, in one embodiment, one LED (26) of the ECM alerts the user of whether power is being supplied to the sump pump system via a power source, such as AC power. This power is detected by one of the plurality of sensors (22) of the ECM, as shown in FIG. 4.

A second LED (28) visually alerts the user when an alarm is going off, which alarm signifies a multitude of errors or malfunctions occurring within the sump pump system (10). Switch (24) of the ECM contains a silence and reset button for the alarm LED of the sump pump system, which alarm may also include an audible component. In this embodiment, a user can hold the silence button for a certain amount time to reset certain features of the sump pump system. For example, in one embodiment, the user can hold button for three seconds to reset any active alarms and return the sump pump system to standby mode, hold the switch for four seconds to initiate an LED and alarm test or hold the button for 12 seconds to completely reset the sump pump system to factory settings and erase all Wi-Fi settings.

A third LED (30) alerts the user as to whether the sump pump system (10) is connected to internet or Wi-Fi and/or is connected to an external control system. This is detected by one of a plurality of sensors (22) of the ECM, see FIG. 2. For example, this third LED may be constantly lit when connected to the router and/or the network communications system. Further, this LED may be off when the sump pump system is in access point mode or may blink when the user is attempting to connect to internet or wi-fi.

In this embodiment, the sump pump system (10) utilizes network technology such as Zoeller's Z Control® Technology as the network communications system, see www.zoellerpumps.com/en-us/products/alarms/z-control-enabled/z-control. The user connects the sump pump system to the Z Control® controller using Internet or Wi-Fi that is built into the ECM (20). When the sump pump system is successfully connected to the Z Control® controller, the user can set up free alert messages via email, text and mobile app "push" notifications and be in continuous communication with the sump pump system. In addition, the user can verify the sump pump system's readiness, remotely silence alarms, reset the unit, configure settings, and modify how notifications are sent.

In this embodiment, the sump pump system (10) is additionally capable of "over the air" firmware updates. It is possible for the sump pump system to perform an update immediately if one is available at the Z Control® controller. For example, if an update is taking place, the Z Control® controller LED will flicker for up to one minute while the update is downloaded. The Z Control® controller LED will be solid, and all other LEDs will turn off while the update is being installed. Further, the sump pump system's alert history on the Z Control® controller will also be updated with the firmware upgrade information, and a notification will be sent to the user.

In this embodiment, the Z Control® controller sends alert notifications for the following conditions, which should not be interpreted as limiting:

a. Self-test completed;
b. Sump pump with ECM active and pumping while logging the start and stopping time of the sump pump with ECM;
c. Locked sump pump with ECM meaning there is high/locked rotor current detected;
d. High water & sump pump with ECM is running normal meaning sump pump with ECM is moving water but high-water sensor is active indicating the sump pump with ECM is not keeping up with incoming water;
e. High water & sump pump with ECM not initially running meaning the high-water sensor is active, indicating a problem with the sump pump with ECM pump with ECM's primary float;
f. High water & sump pump with ECM not running meaning the high-water sensor active, but the sump pump with ECM will not turn on [no motor current or locked sump pump with ECM current] indicating a sump pump with ECM failure.
g. Sump pump with ECM has not run for X days, which excludes self-test run time. The default time is 30 days but can be adjustable via the Z Control® controller.
h. Long Run/Continuous Run condition. The default timeframe is 5 minutes of continuous run for notification to be sent. Time is adjustable via the Z Control® controller. This occurs because there may be an indicated possible reduction in pumping capacity most likely due to the discharge pipe obstruction, or sump pump with ECM intake.
i. Loss of Z Control® controller connection meaning indicated loss of power to sump pump with ECM and/or WIFI router, issue with WIFI router, or Internet service provider issue.
j. Z Control® controller connection restored.
k. Audible alarm for sump pump with ECM running outside of normal operation (Alert conditions: b, c, d, e, f, h, & i)
l. Z Control® controller interface "buttons" to allow running self-test, reset & silence alarms.

Advantageously, the manufacturing site can aid the user in any problems that may occur since the manufacturing site can assign Z Control® controller IDs using wireless communications to the ECM, as well as the ability to set horsepower rating and current limits.

Figure 5:
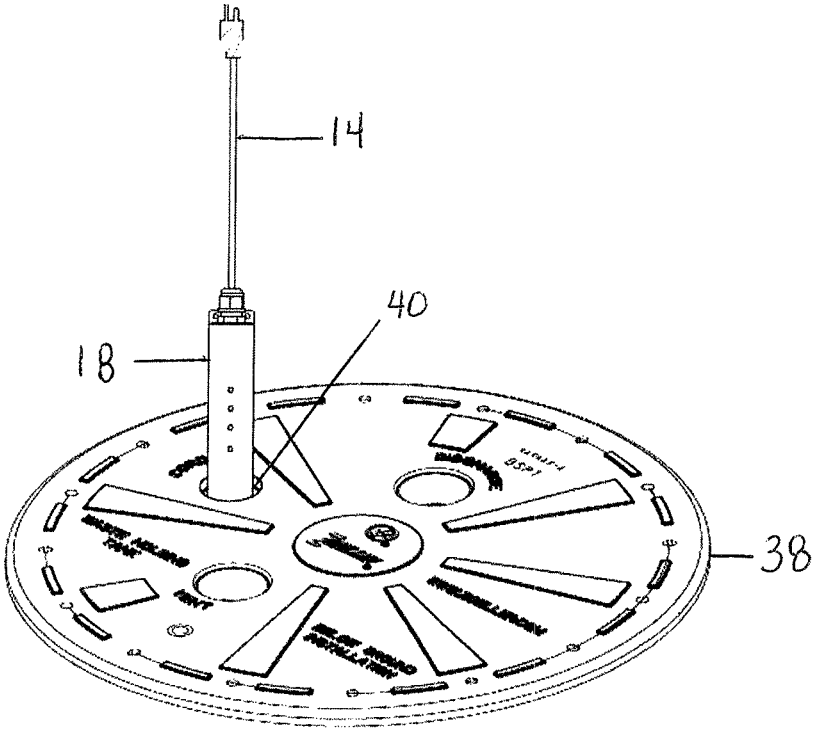

One advantageous aspect of this embodiment is that the sump pump system (10) is a single, continuous assembly and no electrical connections are needed between the pump switches and controls, except for plugging the system into household power. Further, the continuity of the system, with no electrical connections required, enables a narrow design of the electrical cord with the ECM. As shown in FIG. 5, this design advantageously allows the electrical cord (14) with the housing (18) of the ECM (20) to pass through small diameter holes (40) in a sump pump basin cover (38), such as a 2-inch diameter hole, which leads to easier installation of the sump pump system, as there is no need for cutting or drilling of a basin cover.

Further, the ECM (20) is advantageously designed to cover a range of sump pump sizes. The specific size of the sump pump is dictated during manufacture by the assembler by choosing the applicable HP during the programming of the unit. The system then utilizes thresholds that are specific to that model pump, which allows the ECM to be used for several models with varying characteristics, yet still provides feedback and fault information that is relevant and specific to the pump model.

As shown in FIGS. 1-2, in this embodiment, the electrical cord (14) extends from the bottom of the housing (18) to the top portion of the sump pump (12) and this length is about nine feet. Further, although the electrical cord enters the housing as a three-conductor jacketed cable, the electrical cord exits the housing of the ECM as a six-conductor jacketed cable. As shown in FIGS. 1-2, the electrical cord includes a y-splitter (32) between the bottom end of the housing of the ECM and the top portion of the sump pump. This y-splitter produces a four-conductor jacketed cable that continues into the top portion of sump pump and a two-conductor jacketed cable that is connected to a backup float switch (36). The backup float switch secures to a discharge pipe of the sump pump system (10) with a conventional fastener, such as a clamp. The backup float switch is connected to the ECM, which includes a high-water sensor as one of its plurality of sensors (22), as shown in FIG. 4. This high-water sensor advantageously provides float switch backup protection in addition to, but independent from, the float switch (34) that is a component of the sump pump (12). The four-conductor jacketed cable that enters the top portion of the sump pump includes two wires for the sump pump system power, one wire for grounding, and one wire for attachment to a triac switch circuit that allows the ECM circuit board to turn on the pump. The lengths of the four-conductor jacketed cable and the two-conductor jacketed cable can vary, but in this embodiment, both are about thirty-six inches.

It is well recognized by persons skilled in the art that alternative embodiments to those disclosed herein, which are foreseeable alternatives, are also covered by this disclosure. The foregoing disclosure is not intended to be construed to limit the embodiments or otherwise to exclude such other embodiments, adaptations, variations, modifications and equivalent arrangements.

LISTING OF ELEMENTS

Sump pump system (10)
Sump pump (12)
Sump pump electrical cord (14)
Power plug (16)
One section of housing (17)
Housing (18)
Second section of housing (19)
Electronic controller module (20)
Face of the housing (21)
Screws of housing (23)
Switch (24)
Inner contents of the housing (25)
Power LED (26)
Alarm LED (28)
Z Control® LED (30)
Y Splitter (32)
Float Switch (34)
Backup float switch (36)
Basin cover (38)
Hole in Basin cover (40)

The invention claimed is:

1. A sump pump system comprising:

a sump pump;

a sump pump electrical cord connected to the sump pump; and a housing that is secured in line with, and an integral component of, the sump pump electrical cord, wherein an electronic controller module is located within the housing and comprises sensors or processors, a switch, and audible and visual alarms and indicators, wherein one or more of the switch, audible and visual alarms, and indicators is located on a face of the housing, wherein a float switch, which actuates the sump pump, is located external from the sump pump and is connected to the electronic controller module in line with, and an integral component of, the sump pump electrical cord and parallel to an axis of the electrical cord, wherein the housing for the electronic controller module is made of, and sealed with, a water-resistant material, and wherein the float switch is connected to the sump pump electrical cord between the housing of the electrical controller module and the sump pump.

2. The sump pump system of claim 1, wherein the visual alarms and indicators comprise light emitting diodes located on the face of the housing.

3. The sump pump system of claim 1, wherein the float switch connected to the sump pump electrical cord is a back-up float switch.

4. The sump pump system of claim 1, wherein the float switch is connected to a y-splitter in the sump pump electrical cord.

5. The sump pump system of claim 1, wherein the sensors of the electronic controller module detect conditions in the sump pump system selected from the group consisting of operable power, flow of current, and high water.

6. The sump pump system of claim 1, wherein the visual alarms and indicators on the face of the housing illuminate in response to conditions detected by the sensors or processors of the electronic controller module.

7. The sump pump system of claim 1, wherein the audible alarm alerts a user of conditions detected in the sump pump system selected from the group consisting of a locked rotor, high current, low current, no current, high water when the sump pump is running normally, high water without the sump pump running, continuous run of the sump pump and a failed test wherein the sump pump is not able to run.

8. The sump pump system of claim 1, wherein the switch resets the alarm.

9. The sump pump system of claim 7, wherein the switch silences and resets the alarm.

10. The sump pump system of claim 1, wherein the sump pump electrical cord and the housing of the electronic controller module fit through a hole in a sump pump basin cover.

11. The sump pump system of claim 10, wherein the hole is from two to four inches in diameter.

12. The sump pump system of claim 1, wherein the electronic controller module further comprises an internal network.

13. The sump pump system of claim 12, wherein the internal network connects the sump pump system to an external control system.

14. The sump pump system of claim 13, wherein one of the sensors or processors of the electronic controller module detects whether an internet connection is lost between the internal network and the external control system.

15. The sump pump system of claim 14, wherein a user receives a notification on an electronic device via the internal network and the external control system selected from the group consisting of a text message, an email, and a push notification.

16. The sump pump system of claim 15, wherein the notifications are for conditions detected by the sensors or processors of the electronic control module selected from the group consisting of a locked rotor, high current, low current, no current, high water when the sump pump is running normally, high water without the sump pump running, continuous run of the sump pump, a failed test wherein the sump pump is not able to run to the sump pump and a loss of power fault of the Internet connectivity.

* * * * *